US012742331B2

(12) United States Patent
Jiang et al.

(10) Patent No.: US 12,742,331 B2
(45) Date of Patent: Sep. 22, 2026

(54) DECORATIVE SHUTTERS WITH PACKAGING STRUCTURE

(71) Applicant: THREE STONE, LLC, San Jose, CA (US)

(72) Inventors: Jinglei Jiang, Yuyao (CN); Shangxi Jiang, Yuyao (CN)

(73) Assignee: YIXIANG BLOW MOLDING FURNITURE CO., LTD., Yuyao (CN)

( * ) Notice: Subject to any disclaimer, the term of this patent is extended or adjusted under 35 U.S.C. 154(b) by 172 days.

(21) Appl. No.: 18/765,966

(22) Filed: Jul. 8, 2024

(65) Prior Publication Data

US 2025/0075515 A1 Mar. 6, 2025

(30) Foreign Application Priority Data

Aug. 31, 2023 (CN) ..... 202322357133.1

(51) Int. Cl.
*E04F 19/00* (2006.01)

(52) U.S. Cl.
CPC ..... *E04F 19/00* (2013.01)

(58) Field of Classification Search
CPC ..... E04F 19/00
USPC ..... 52/782.1
See application file for complete search history.

(56) References Cited

U.S. PATENT DOCUMENTS 5,060,442 A * 10/1991 Chubb ..... E06B 9/04 52/473
5,761,865 A * 6/1998 Schiedegger ..... E06B 7/082 52/475.1
5,946,873 A * 9/1999 Schiedegger ..... E06B 7/082 52/745.19
6,214,428 B1 * 4/2001 Henderson ..... B27M 3/0046 238/14
6,374,560 B1 * 4/2002 Schiedegger ..... E06B 7/08 52/666
6,968,656 B2 * 11/2005 Schiedegger ..... E06B 9/04 52/475.1
8,341,912 B2 * 1/2013 Verna ..... E06B 9/04 52/473

* cited by examiner

*Primary Examiner* — James J Buckle, Jr.
(74) *Attorney, Agent, or Firm* — Platinum Intellectual Property PC

(57) ABSTRACT

The present subject matter discloses a decorative vinyl shutter with diversified and compact design features. The main panels of the shutter can have pre-formed installation areas for decorative panels that can be installed on-site. According to some embodiments, the separable and changeable decorative panels can offer more color and texture choices to match a house's architectural style. Furthermore, before the onsite assembly and during the transportation, the decorative panels can be stored within the storage cavity integrally formed at the back of the main panels, resulting in compact and economical packaging. In addition, the assembly of the vinyl shutter can be easy and quick, without the aid of additional tools.

9 Claims, 9 Drawing Sheets

DECORATIVE SHUTTERS WITH PACKAGING STRUCTURE

CROSS-REFERENCES TO RELATED APPLICATIONS

This application claims the priority of Chinese Application No. 202322357133.1, filed Aug. 31, 2023, which is incorporated herein by reference for all purposes.

TECHNICAL FIELD

The present subject matter is in the field of vinyl or plastic furniture. More particularly, embodiments of the present subject matter relate to decorative window shutters with optimized packaging features.

BACKGROUND

Plastic or vinyl decorative shutters have been increasingly popular due to their low cost, lightweight and appealing decorative effect. However, the present vinyl shutters are designed to provide functional and decorative features without consideration for rendering packaging and transportation benefits. For example, traditional plastic shutters generally use integrally formed panels with a single color, shape and design. In addition, the present vinyl shutters often lack diverse styles and choices for the user. In order to offer diversified colors, shapes and designs, a shutter window needs to comprise many separate panels and components, which are not only difficult to assemble but also increase the packaging volume which leads to higher transportation costs.

Therefore, there is a need to improve the present shutter designs to enhance the aesthetic effect while facilitating packaging and transportation convenience.

SUMMARY OF THE INVENTION

The present subject matter is directed to optimized designs of decorative vinyl shutters with diverse designs and compact packaging features that can improve assembly efficiency and reduce transportation costs. Embodiments of the present subject matter are discussed below with reference to FIGS. 1-9.

In the following description, for purposes of explanation, numerous specific details are set forth in order to provide a thorough understanding of the present subject matter. It will be apparent, however, to one skilled in the art that the present subject matter may be practiced without some of these specific details. In addition, the following description provides examples, and the accompanying drawings show various examples for the purposes of illustration. Moreover, these examples should not be construed in a limiting sense as they are merely intended to provide examples of embodiments of the subject matter rather than to provide an exhaustive list of all possible implementations. In other instances, well-known structures and devices are shown in block diagram form in order to avoid obscuring the details of the disclosed features of various described embodiments.

According to some embodiments, the present subject matter is directed to a vinyl shutter that comprises one or more decorative panels, wherein the one or more decorative panels have pre-formed connecting portions. The vinyl shutter further comprises a main panel that is integrally formed, wherein the front surface of the main panel has pre-formed installation areas configured to install the decorative panels during assembly. Furthermore, the installation areas further comprise connecting holes configured to couple with the pre-formed connecting portions on the decorative panels. In addition, the back surface of the main panel is pre-configured to form a storage space for the decorative panels during the transportation of the vinyl shutter.

According to some embodiments, the storage space of the decorative panels is formed by a number of main panel sides and storage ribs pre-formed on the back surface of the main panel. In addition, the storage space is further completed by a second plurality of main panel sides and storage ribs pre-formed on the back surface of a paired second main panel.

According to some embodiments, the installation areas further comprise one or more fixation holes configured to install the main panel to a wall. According to some embodiments, the decorative panels are connected to the main panel via at least one of snap-fitting or plug-fitting during assembly.

According to some embodiments, the pre-formed connecting portions of the decorative panels comprise one or more L-shaped first buckles and the connecting holes of the main panel comprise matching first buckle holes for the one or more L-shaped first buckles.

According to some embodiments, the L-shaped first buckle is a snap component pre-formed on a decorative panel side, and the snap component further comprises a vertical portion connected with a horizontal portion and a stopper with a protruding portion. Furthermore, the matching first buckle holes comprise a sliding portion connected with a clamping portion with a blocking wall and a protruding portion to couple with the snap component.

According to some embodiments, the pre-formed connecting portions of the decorative panels comprise a second buckle and the connecting holes of the main panel comprise a matching second buckle hole for the second buckle.

According to some embodiments, the second buckle is a plug component. According to some embodiments, the second buckle hole comprises a connected left hole and a connected right hole configured to couple with the plug component.

According to some embodiments, the pre-formed connecting portions of the decorative panels comprise plug buckles and the connecting holes of the main panel comprise matching plug buckle holes for the plug buckles.

According to some embodiments, a plug buckle further comprises a head with expandable cross slots configured to affix to a connecting hole of the main panel. Furthermore, the decorative panels and the main panel are one-piece vinyl components that are integrally formed.

According to some embodiments, the present subject matter is directed to a vinyl shutter that comprises one or more decorative panels, wherein the decorative panels have the first connecting portions. The vinyl shutter further comprises a main panel that can connect with the decorative panels, wherein the front surface of the main panel has pre-formed installation areas configured to install the decorative panels during assembly, wherein the installation areas further comprise second connecting portions configured to couple with the first connecting portions on the decorative panels, and wherein the back surface of the main panel is pre-configured to form a storage space for the decorative panels during the transportation of the vinyl shutter.

According to some embodiments, the storage space of the decorative panels is formed by a first plurality of main panel sides and storage ribs pre-formed on the back surface of the main panel. Furthermore, the storage space of the decorative panels is further completed by a second plurality of main panel sides and storage ribs pre-formed on the back surface of a paired second main panel.

According to some embodiments, the present subject matter is directed to a decorative panel for a vinyl shutter that comprises one or more pre-formed first connecting portions configured to be coupled to one or more second connecting portions of a main panel of the vinyl shutter during assembly, wherein the decorative panel, during transportation, is stored within a storage space pre-formed on the back surface of the main panel.

According to some embodiments, the storage space of the decorative panel is formed by a first plurality of main panel sides and storage ribs pre-formed on the back surface of the main panel. Furthermore, the storage space of the decorative panel is further completed by a second plurality of main panel sides and storage ribs pre-formed on the back surface of a paired second main panel that can be coupled with the main panel during transportation.

Other aspects and advantages of the present subject matter will become apparent from the following detailed description taken in conjunction with the accompanying drawings, which illustrate, by way of example, the principles of the present subject matter.

DESCRIPTION OF DRAWINGS

The present subject matter will be further described in detail below with reference to the embodiments of the accompanying drawings.

DETAILED DESCRIPTION

It is to be understood that even though numerous characteristics and advantages of various embodiments of the present subject matter have been set forth in the foregoing description, together with details of the structure and function of various embodiments of the subject matter, this disclosure is illustrative only. In some cases, certain subassemblies are only described in detail with one such embodiment. Nevertheless, it is recognized and intended that such subassemblies may be used in other embodiments of the subject matter. Practitioners skilled in the art will recognize many modifications and variations. Changes may be made in detail, especially matters of structure and management of parts within the principles of the embodiments of the present subject matter to the full extent indicated by the broad general meaning of the terms in which the appended claims are expressed.

According to some embodiments, the decorative vinyl shutter of the present subject matter can provide compact packaging features that improve assembly efficiency and reduce transportation costs. In addition, as the main panel and decorative panels are separated parts, the decorative vinyl shutter can offer diversified designs that meet various aesthetic preferences.

According to some embodiments, the vinyl shutter comprises one main panel and a number of decorative panels, e.g., N in number. Furthermore, both the main panel and the decorative panels are one-piece plastic parts that are integrally formed, in contrast with traditional construction by several smaller components. Such a design is ideal for vinyl windows or doors.

Figure 1:
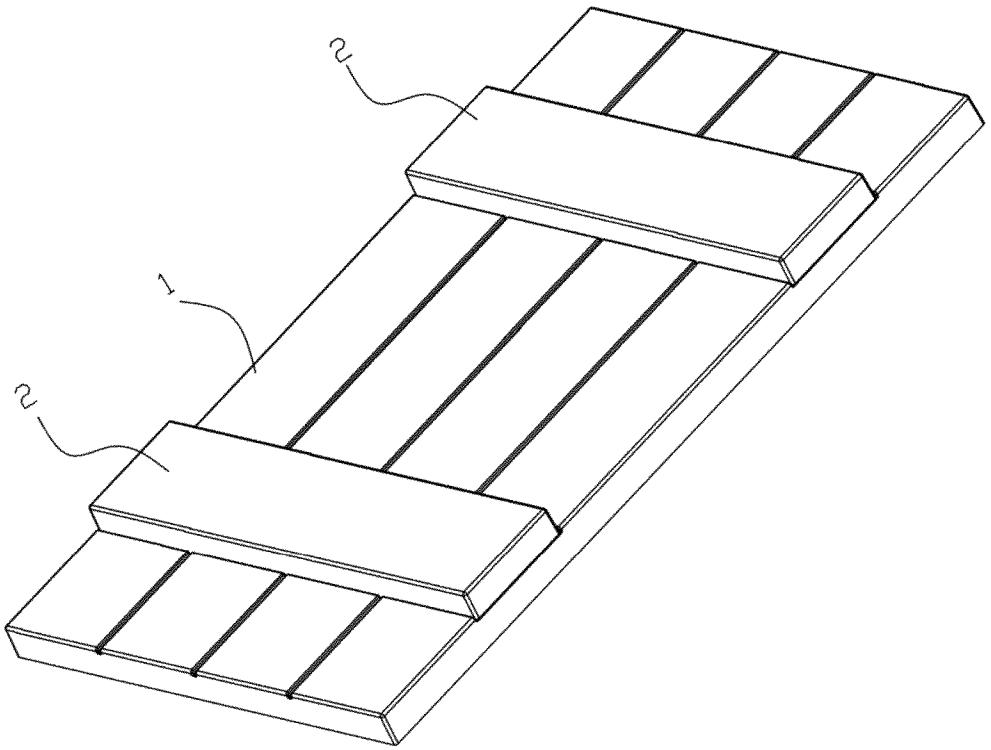
FIG. 1 is a schematic diagram of one embodiment of the decorative vinyl shutter.

According to some embodiments, the number of decorative panels is twice that of the main panels. In another example, the number of decorative panels is three times that of the main panels. As shown in FIG. 1, the decorative panels 2 can be installed on the front surface of the main panel 1, ideally, to form a concave or convex surface. This way, the surface of the vinyl shutter is uneven and characteristic, rendering a more realistic view. In particular, the decorative panels, being separable from the main panel, can be interchanged with a different style of the decorative panel, which offers more style choices for the user. Furthermore, the individual panels can have a different color from the main panel, further enhancing the diversified choices to match the house's style or to meet the user's preference.

According to some embodiments, the decorative panels 2 can be affixed to the main panel 1 via various coupling mechanisms. For example, they can be connected via one or more of a snap-fitting or a plug-fitting mechanism. Furthermore, other fitting methods, such as screws, glue, or a combination of several methods, can be implemented.

Figure 7:
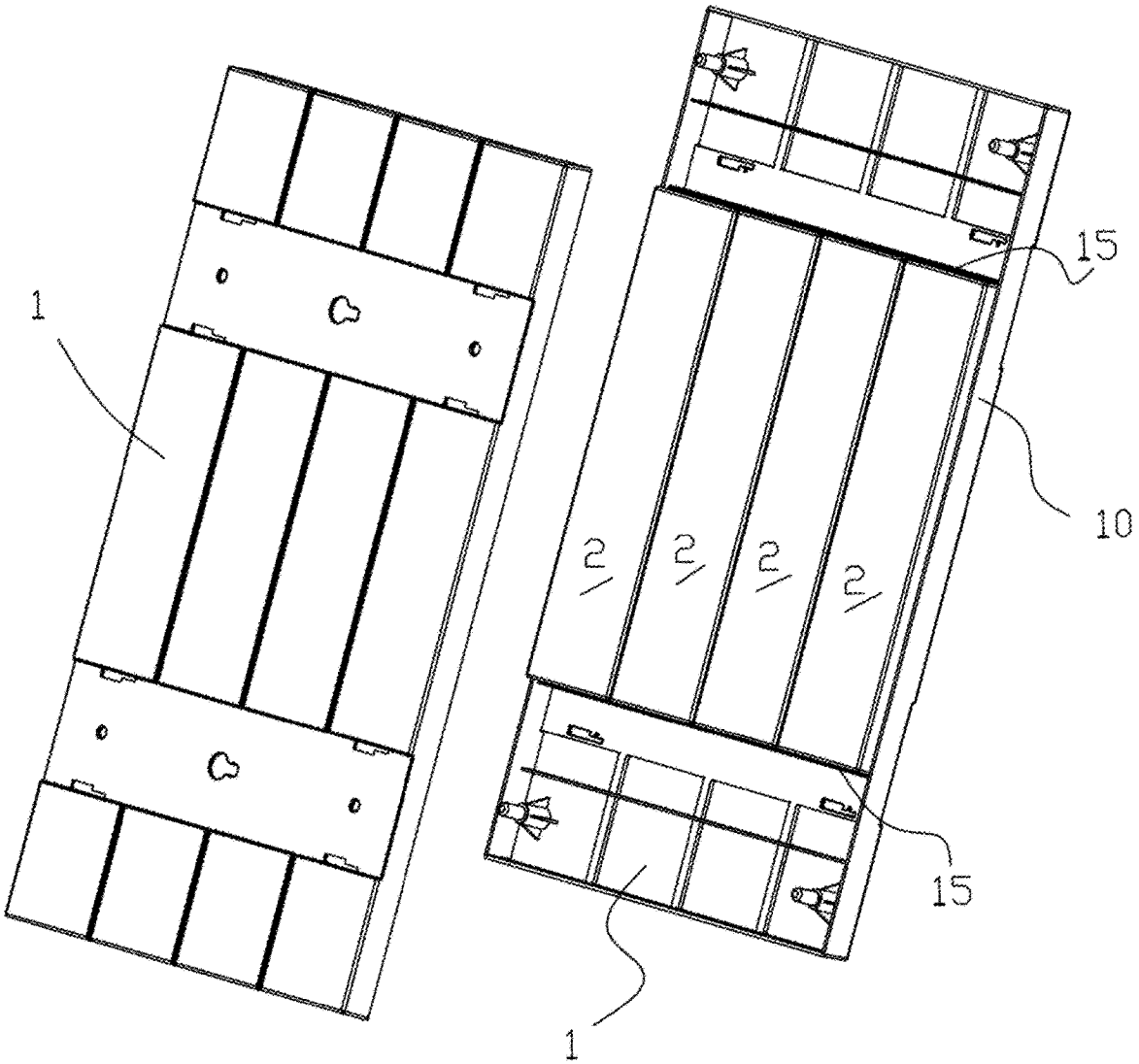
FIG. 7 is a dissected view of the pair of decorative vinyl shutters as shown in FIG. 6.
Figure 8:
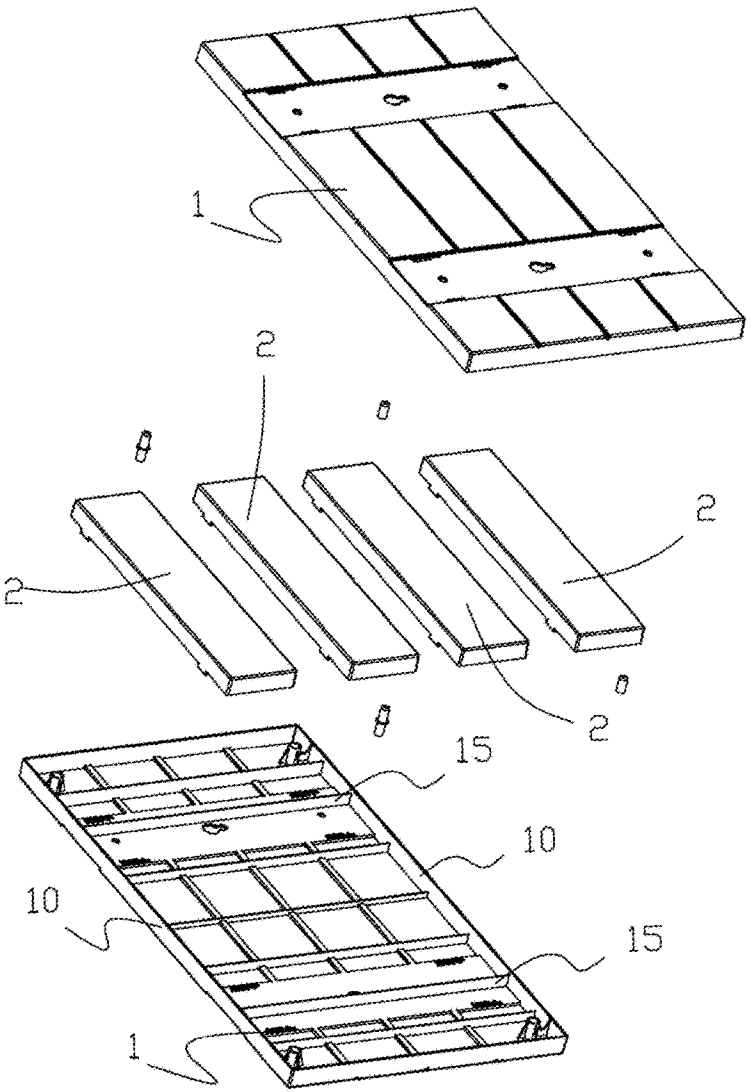
FIG. 8 is a further dissected view of the pair of decorative vinyl shutters as shown in FIG. 6.
Figure 9:
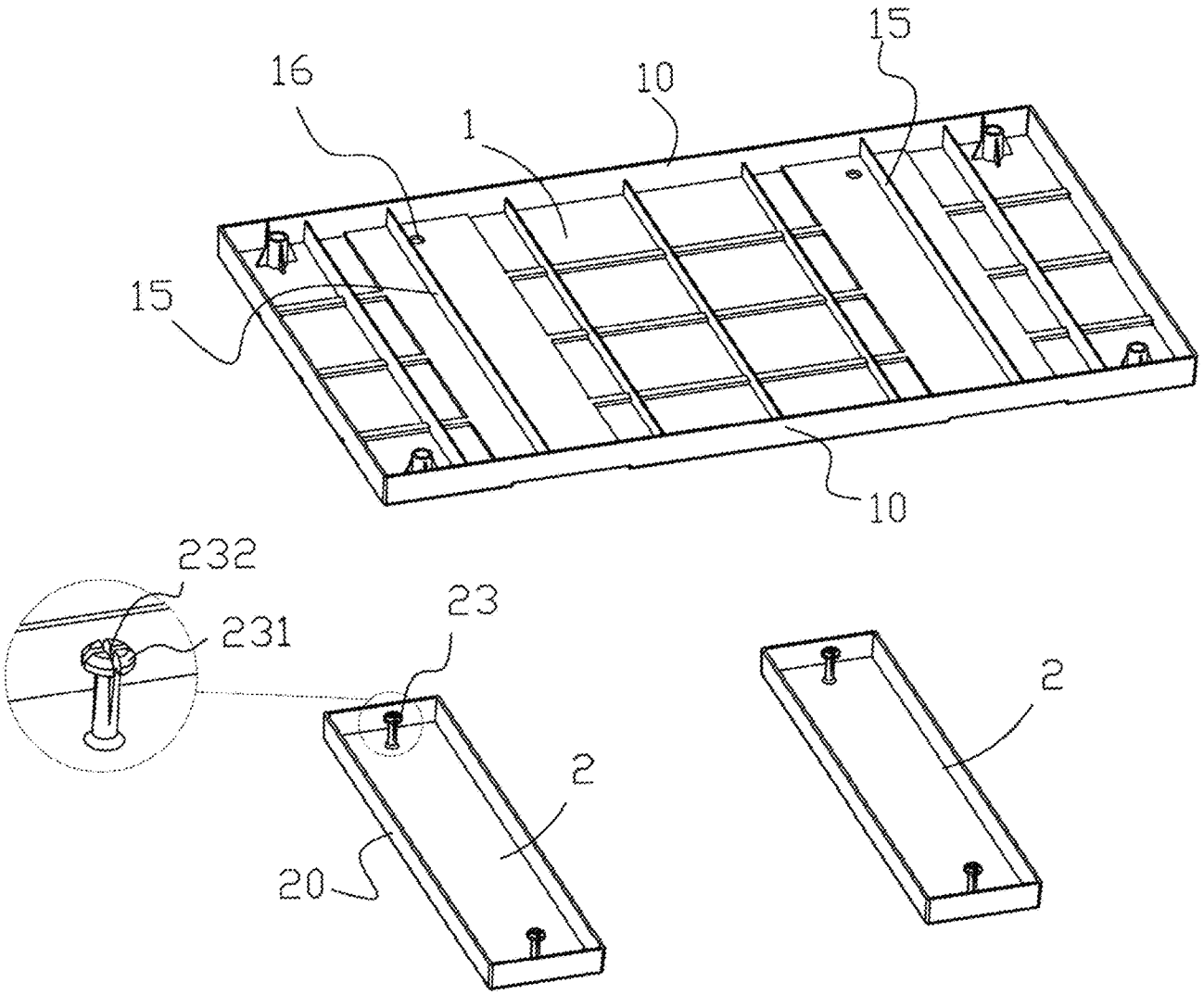
FIG. 9 is another a schematic diagram of another embodiment of the decorative vinyl shutter.

According to some embodiments, FIG. 1-8 can show a decorative shutter with panels constructed by snap-on connectors, whereas FIG. 9 can show a shutter with panels with plug-in connectors.

Figure 2:
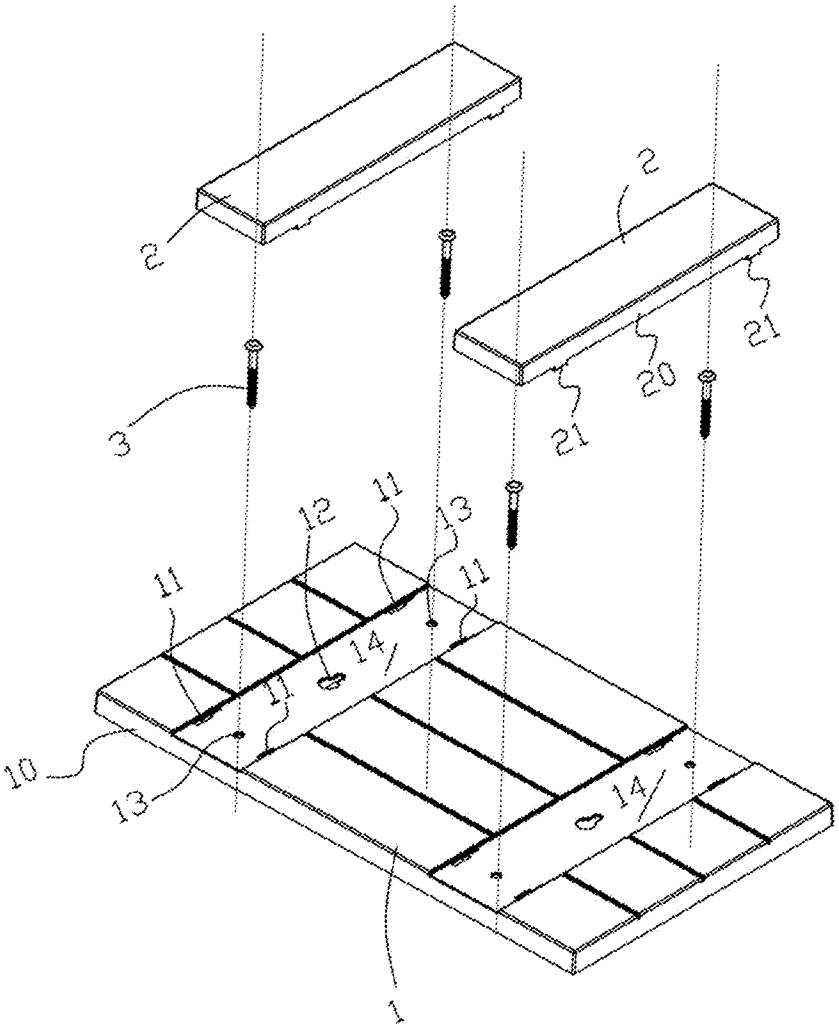
FIG. 2 is an exploded view of the decorative vinyl shutter shown in FIG. 1.

As shown in FIG. 2, main panel 1 can be a rectangular panel suitable as a shutter frame. According to some embodiments, two transversely arranged rectangular installation areas 14 can be provided on the front side along the height direction of main panel 1. Installation areas 14 can be provided for affixing decorative panels 2 to the shutters. According to some embodiments, To facilitate the sliding and inserting of decorative panels 2, installation areas 14 can be in the form of a groove.

Figure 4:
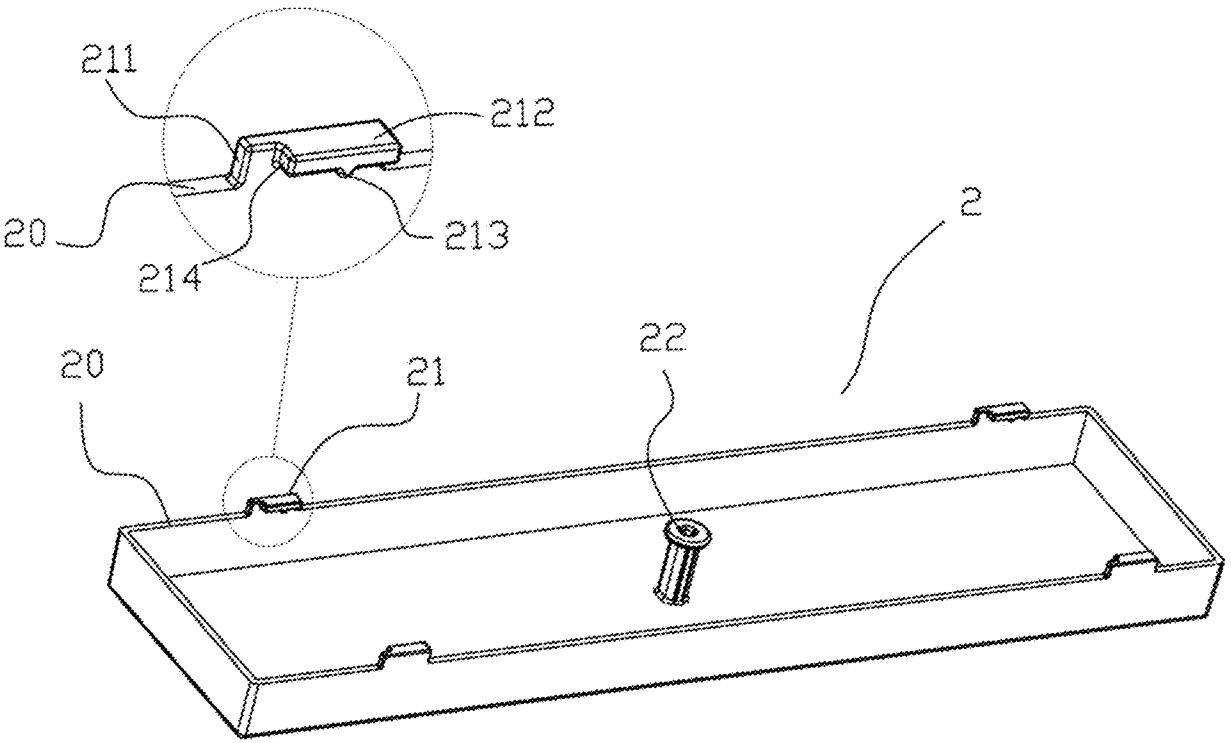
FIG. 4 is a structure diagram of a decorative panel according to one embodiment of the decorative vinyl shutter.

According to some embodiments, first buckle holes 11 can be provided at each of the four corners of an installation area 14, which can be snapped with corresponding first buckles 21 on decorative panels 2. As shown in FIG. 4, first buckles 21 can comprise a vertical portion connected to the horizontal portion 212 that is shaped by protruding portion 213 and stopper 214.

Figure 5:
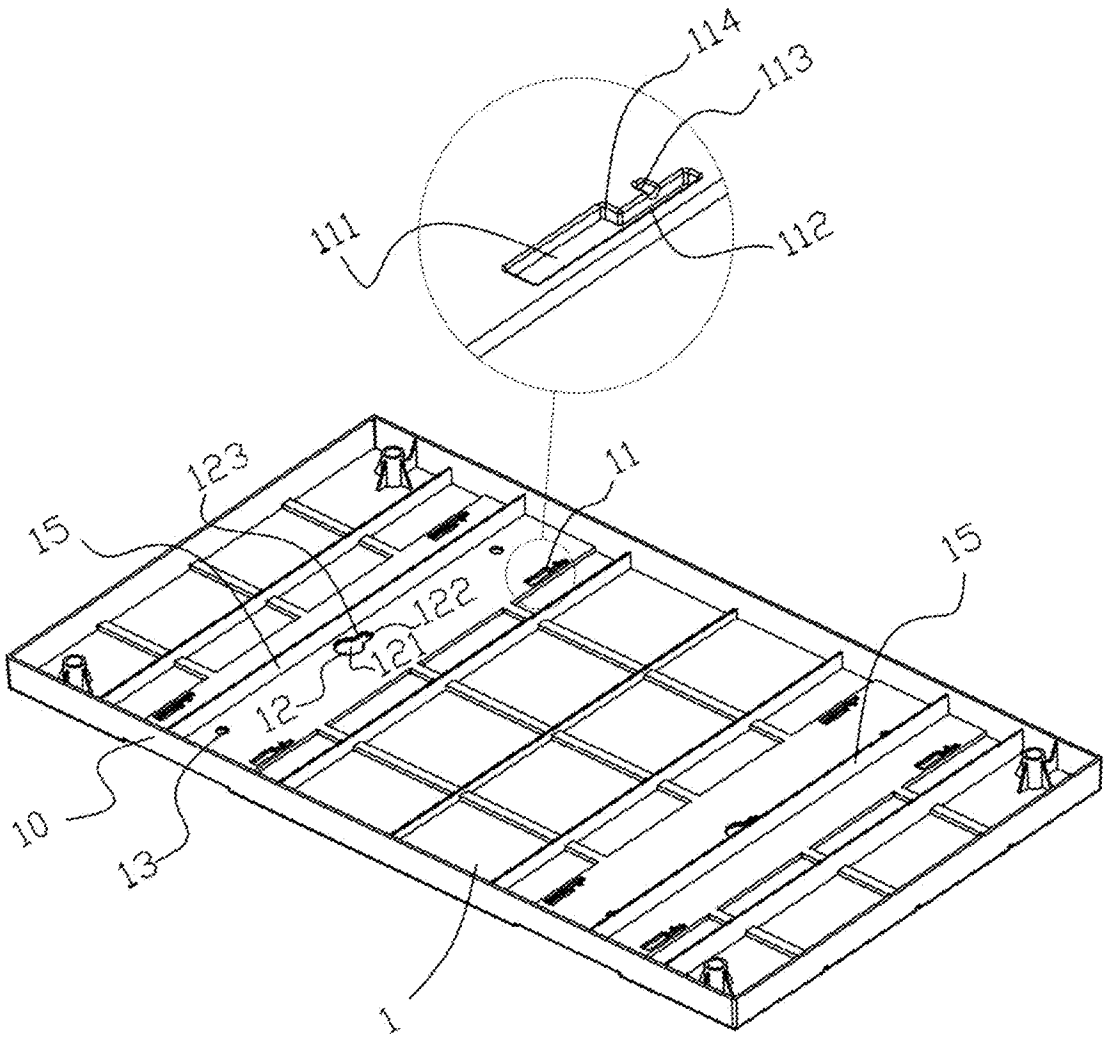
FIG. 5 is a rear view of a main panel according to one embodiment of the decorative vinyl shutter.

As further seen in FIG. 5, a first buckle hole 11 can comprise a sliding portion 111 configured for a first buckle 21 to slide into, a clamping portion 112 configured for engaging with a first buckle 21, and a concave portion 113 configured to abut against a stopper 214 of first buckle 21. First buckle hole 11 can further comprise a concave portion 113 located in the clamping portion 112 that is configured to engage with the protruding portion 213 of first buckle 21.

Figure 3:
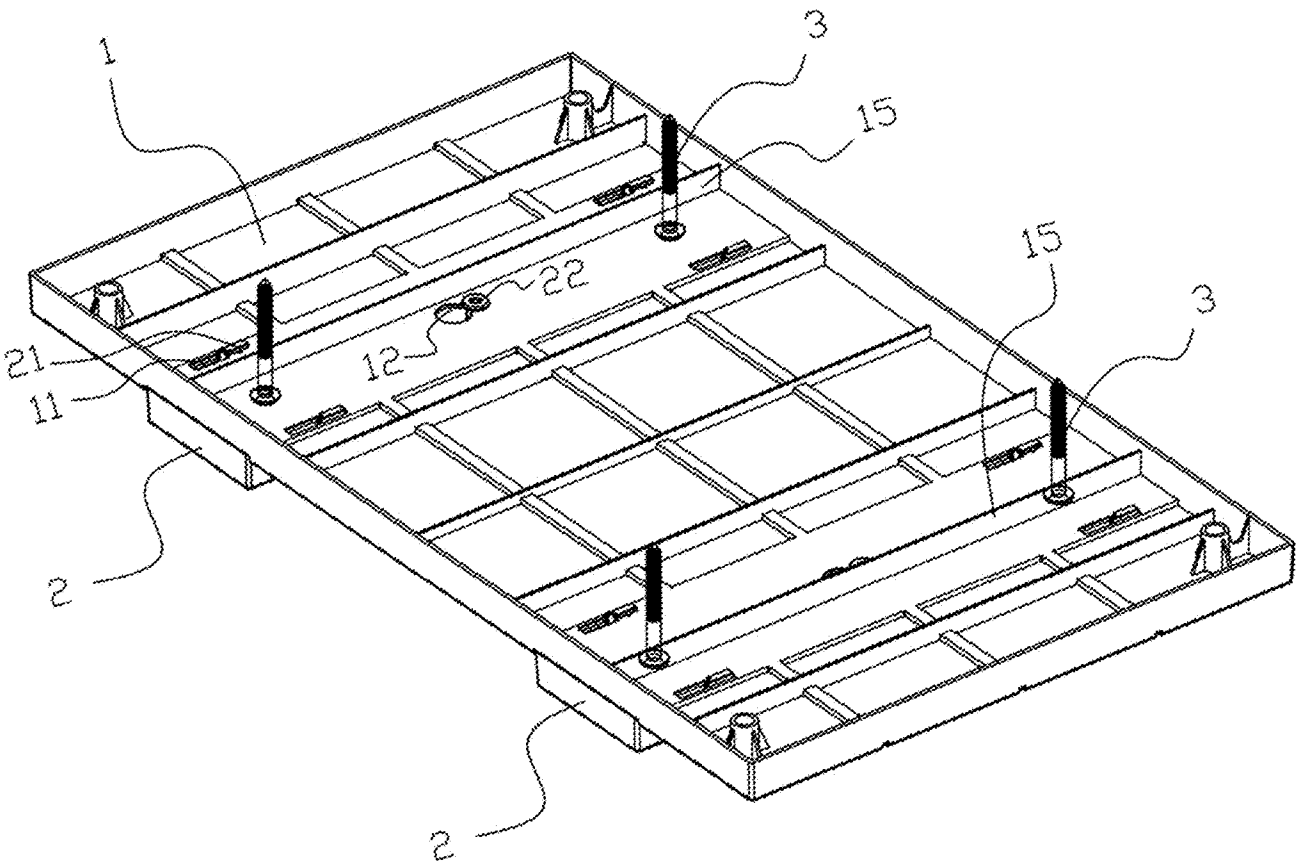
FIG. 3 is a rear view of the decorative vinyl shutter shown in FIG. 1.

As shown in FIGS. 3 and 4, a decorative panel 2 can further comprise a second buckle 22 for engaging with a second buckle hole 12 located at the center of the installation area 14 of main panel 1. As shown in FIG. 5, the second buckle hole 12 can comprise a connected left hole 121 and a connected right hole 122. The connected left hole 121 is C-shaped, which can allow the second buckle 22 to be inserted into and then be slid into the narrower, connected right hole 122 to be locked. According to some embodiments, the connected right hole 122 can be rectangular-shaped and have a recess 123 which can be engaged and limited after the second buckle 22 slides in. Furthermore, the second buckle 22 of the decorative panel can have embedded ribs to be locked within the recess 123.

As shown in FIGS. 3 and 4, when installing the decorative panel 2 on the main panel 1, the user can first insert the second buckle 22 of the decorative panel 2 into the second buckle hole 12 of the main panel 1, and then push it horizontally so that the remaining buckles, e.g., first buckles 21, can be snapped into the corresponding buckle holes, e.g., first buckle holes 11.

According to some embodiments, the vinyl shutter can be secured to the wall via a connector. As shown in FIG. 2, a fixation hole 13, located at the center of the installation area 14, can receive a fixation component 3 so that the shutter can be fixed to the wall. An example of the fixation component 3 can be a screw. The fixation component 3 can be concealed by decorative panel 2 so that it is not exposed to reduce the aesthetic appearance.

According to some embodiments, the decorative panels, during transportation and prior to the assembly, can be conveniently stored within a pre-formed storage space at the back of the main panel. As shown in FIGS. 7 and 8, to facilitate packaging and transportation, the back of the main panel 1 can provide main panel sides 10 formed by extending downward from the top periphery thereof and storage ribs 15 for limiting the decorative panels. The storage ribs 15 are provided along the width direction of the main panel 1, and there are at least two upper and lower storage ribs.

According to some embodiments, the decorative panels 2 can be vertically stored between the two storage ribs 15, as shown in FIG. 7. In the packaged state, the cavity formed by the main panel sides 10 and the storage ribs 15 can accommodate twice the number of decorative panel panels 2 (i.e., 2 N pcs) of a main panel. Furthermore, the length of the decorative panels 2 is the same length as the two storage ribs 15.

Figure 6:
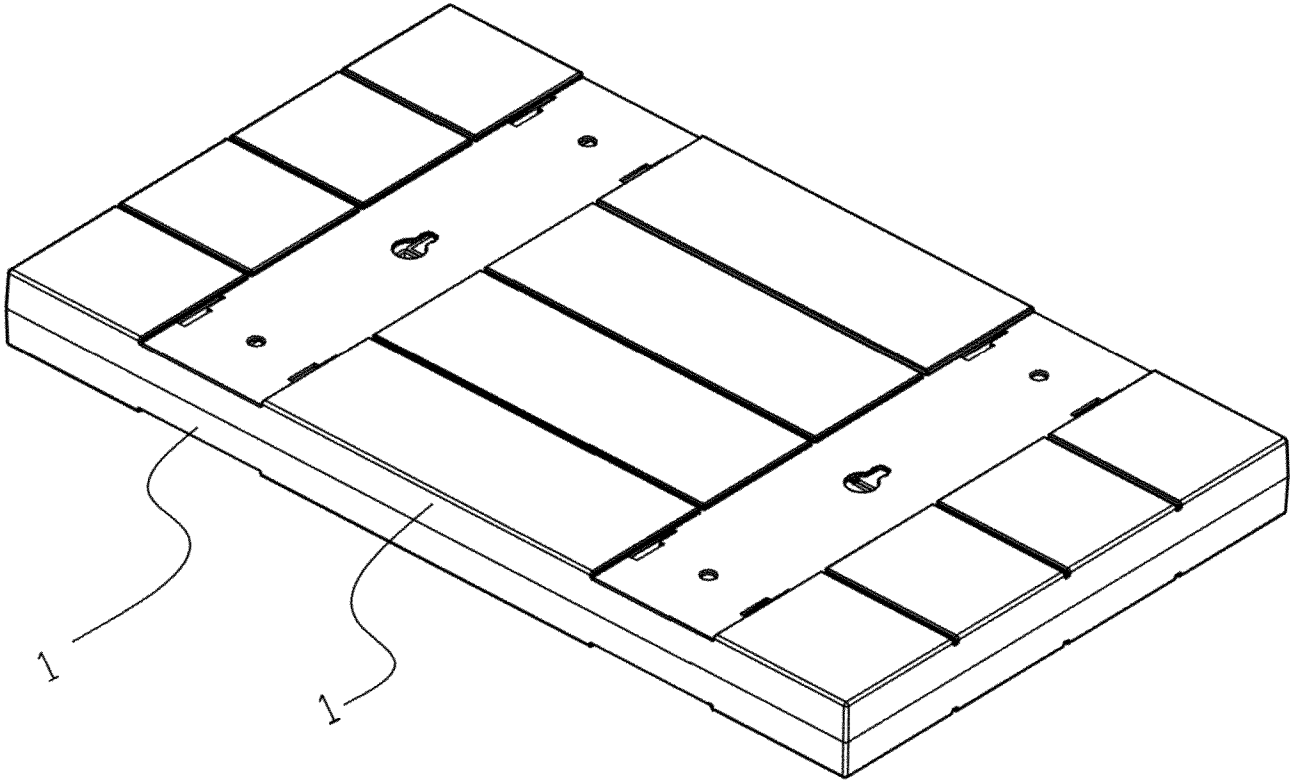
FIG. 6 is a schematic diagram of a pair of decorative vinyl shutters in its transportation stage.

In addition, this storage civility is further completed by a second plurality of main panel sides and storage ribs pre-formed on the back surface of a paired second main panel that can be seen in FIG. 8. This way, during the transportation, two main panels 1 of a shutter can be packed together in pairs, and all the decorative panels 2 on the two panels (2×N=4 pcs) can be stored inside, i.e., the four decorative panels are arranged vertically side by side as shown in FIGS. 6 to 8. This compact design can reduce the packaging volume and lower the transportation cost.

According to some embodiments, the decorative panel 2 can be affixed to the main panel in a plug-fitting mechanism. As shown in FIG. 9, decorative panel 2 can have one or more plug buckle 23. According to some embodiments, the decorative panel 2 can be rectangular with a decorative panel side 20. A number of plug buckles 23, in corresponding to the plug holes 16 on the main panel 1, can be arranged.

According to some embodiments, the plug buckle 23 can be in the shape of a thumbtack with an expandable cross slot 232 openable along the axial direction from the head 231. When the head 231 expands, its diameter is larger than the hole diameter of the plug holes 16. The plug hole 16 can be circular which matches the plug buckle 23. When the decorative panel 2 is installed, the plug buckle 23 is inserted and limited by the expandability of the head 231, so that the installation can be conveniently completed without the necessity of other tools.

The above are only the preferred embodiments of the present subject matter. It should be pointed out that for those of ordinary skill in the art, without departing from the principle of the present subject matter, various modifications or improvements can be made to the present subject matter, such as in other applications. For example, the disclosed features can be incorporated into other molded plastic furniture assemblies, or these features, when applicable, can be incorporated into non-molded plastic furniture assembly, and these are all considered to be within the protection scope of the present subject matter.

It is to be understood that even though numerous characteristics and advantages of various embodiments of the present subject matter have been set forth in the foregoing description, together with details of the structure and function of various embodiments of the subject matter, this disclosure is illustrative only. In some cases, certain subassemblies are only described in detail with one such embodiment. Nevertheless, it is recognized and intended that such subassemblies may be used in other embodiments of the subject matter. Practitioners skilled in the art will recognize many modifications and variations. Changes may be made in detail, especially matters of structure and management of parts within the principles of the embodiments of the present subject matter to the full extent indicated by the broad general meaning of the terms in which the appended claims are expressed.

Having disclosed exemplary embodiments and the best mode, modifications and variations may be made to the disclosed embodiments while remaining within the scope of the embodiments of the subject matter as defined by the following claims.

What is claimed is:

1. A vinyl shutter, comprising: one or more decorative panels, wherein the one or more decorative panels have pre-formed connecting portions; and a main panel that is integrally formed, wherein a front surface of the main panel has pre-formed installation areas configured to install the one or more decorative panels during assembly, wherein the installation areas further comprise connecting holes configured to couple with the pre-formed connecting portions on the one or more decorative panels, wherein a back surface of the main panel is pre-configured to form a storage space for the one or more decorative panels during the transportation of the vinyl shutter, an wherein the storage space for the one or more decorative panels is formed by a first plurality of main panel sides and storage ribs pre-formed on the back surface of the main panel.

2. The vinyl shutter of claim 1, wherein the storage space of the one or more decorative panels is further completed by a second plurality of main panel sides and storage ribs pre-formed on the back surface of a paired second main panel.

3. The vinyl shutter of claim 1, wherein the installation areas further comprise one or more fixation holes configured to install the main panel to a wall.

4. The vinyl shutter of claim 1, wherein the one or more decorative panels are connected to the main panel via one or more of snap-fitting or plug-fitting during assembly.

5. The vinyl shutter of claim 1, wherein the pre-formed connecting portions of the one or more decorative panels comprise one or more L-shaped first buckles and wherein the connecting holes of the main panel comprise matching first buckle holes for the one or more L-shaped first buckles.

6. The vinyl shutter of claim 5, wherein a L-shaped first buckle comprises a snap component pre-formed on a decorative panel side, wherein the snap component further comprises a vertical portion connected with a horizontal portion and a stopper with a protruding portion.

7. The vinyl shutter of claim 5, wherein the matching first buckle holes comprise a sliding portion connected with a clamping portion with a blocking wall and a protruding portion.

8. The vinyl shutter of claim 5, wherein the pre-formed connecting portions of the one or more decorative panels comprise a second buckle and wherein the connecting holes of the main panel comprise a matching second buckle hole for the second buckle.

9. The vinyl shutter of claim 8, wherein the second buckle is a plug component.

* * * * *